United States Patent [19]

Dixon

[11] Patent Number: 4,550,908

[45] Date of Patent: Nov. 5, 1985

[54] PHYSICAL-REHABILITATION AND EXERCISING APPARATUS

[76] Inventor: Voris F. Dixon, 1937 E. Blair Ave., Santa Ana, Calif. 92705

[21] Appl. No.: 570,889

[22] Filed: Jan. 16, 1984

[51] Int. Cl.[4] ..... A61H 1/02

[52] U.S. Cl. ..... 272/130; 272/96; 272/134; 272/145; 272/DIG. 1; 128/25 R

[58] Field of Search ..... 272/130, 131, 144, 72, 272/134, 73, DIG. 1; 128/25 R, 25 B, 24 R

[56] References Cited

U.S. PATENT DOCUMENTS 3,976,058 8/1976 Tidwell ..... 128/25 R

*Primary Examiner*—Richard J. Apley
*Assistant Examiner*—James Prizant
*Attorney, Agent, or Firm*—Francis X. LoJacono

[57] ABSTRACT

A physical-rehabilitation and exercise apparatus designed to aid in rehabilitating disabled individuals, particularly stroke victims who have been partially paralyzed. The apparatus is defined by a frame structure having an adjustable seat which incorporates individually operable right and left arm-control actuators, and right and left leg-control actuators. The arm-control actuators together with the leg-control actuators are adjustably slidable so as to provide a reciprocal longitudinal action which is determined by the proper selection of valves within a hydraulic system that includes a plurality of cylinders, each being integrally formed as part of the respective arm and leg control actuators, whereby a series of sequential operations can be selected by the user to provide the necessary movement for exercising the disabled limb or limbs.

8 Claims, 9 Drawing Figures

PHYSICAL-REHABILITATION AND EXERCISING APPARATUS

BACKGROUND OF THE INVENTION

1. Field of the Invention

This invention relates generally to an exercising device, and more particularly to a combination physical-rehabilitation and exercising apparatus to aid handicapped or disabled individuals in developing a program of selective physical therapy, whereby the healthy limbs cooperate with the apparatus to exercise the disabled limbs.

2. Description of the Prior Art

Various problems and difficulties are being encountered in providing suitable exercising machines for the disabled and the handicapped, particularly with respect to stroke victims.

Many types of exercising devices are available as a means for assisting individuals to physically improve or to sustain their bodies in a healthy condition. However, these known devices are generally designed for those who are not physically disabled or handicapped. Thus, such devices have features that usually restrict their use to those individuals who are capable of using all of their limbs. Also, these devices are too complicated to operate and thus can not be used in a physical-therapy program. Furthermore, the average individual can not make use of the known devices, since they are usually costly to purchase and expensive to maintain.

As some of examples of exercising machines, one might consider the following issued United States patents:

U.S. Pat. No. 1,909,002 (Oehlberg) provides an orthopedic device primarily for use by children for the purpose of correcting weaknesses in one or two limbs, where there is an imbalance with respect to the corresponding limbs or the other side of one's body. The invention consists of rotatable handles and peddles interconnected by a common chain; and the alleged principal advantage is that the respective handles and peddles can be adjusted relative to one another to vary the phase or relative position of the various extremities, so that motion may be either reciprocatory or unisonous. Thus, the user thereof must apply all four limb forces to the device simultaneously, and there is no relative independence to effect motion of only one limb.

Variations of the Oehlberg concept are found in the patents to Sbarra (U.S. Pat. No. 2,783,044), Nies (U.S. Pat. No. 3,572,699), Grant (U.S. Pat. No. 3,824,993) and Hooper (U.S. Pat. No. 4,188,030). In all of these disclosed devices, one may use just his hands or his legs to effect rotation of a wheel. In all cases, however, there is no apparent opportunity for independence between opposed limbs, such as right leg/left arm, or any selected combination thereof.

U.S. Pat. No. 3,742,940 to Phiffer discloses an impact pressure therapy apparatus used by a patient for rehabilitation of one leg or hip at a time, and is motorized to facilitate motion of the impaired leg.

There is a physical-coordination training device disclosed in U.S. Pat. No. 3,976,058 to Tidwell which includes a frame structure having right and left hand levers, and right and left foot levers pivotally connected to the frame, with right and left connecting links pivotally connected between the right-hand and left-foot levers, respectively.

SUMMARY OF THE INVENTION

The present invention has for an important object to provide a physical rehabilitation and exercise apparatus that is particularly designed to overcome the problems now existing in known therapy apparatuses which do not have a wide range of varying operational arrangements to aid in the rehabiliation of disabled and handicapped individuals.

Another object of the present invention is to provide a physical rehabilitation and exercise apparatus that can be used by stroke victims, for example, who are paralyzed and have loss of movement in one or more limbs.

Still another object of the invention is to provide a device of this type that can be readily adjusted to a particular individual for selective limb exercising when he or she does not have use of all four limbs due to stroke or other ailments.

A further object of the invention is to provide an apparatus of this character that includes a frame structure having an adjustable seat that enables the user to walk into the apparatus and sit with a minimum of effort, whereby he or she is positioned in the apparatus with the right and left feet placed on and attached to respective foot-support guides, while the hands are positioned to engage or grasp the respective handle bars.

A still further object of the invention is to provide an apparatus of this character that utilizes a hydraulic system which includes four hydraulic cylinders, each being associated with a respective arm and leg of the user, and a plurality of valve units, whereby each cylinder can be selectively caused to exercise the attached limb by the movement of any one of the user's active limbs.

It is a further object of the invention to provide a rehabilitation apparatus for partially paralyzed victims that is readily adjustable for selective limb exercises by means of the proper selection of the hydraulic valve members.

It is still a further object of the invention to provide a device of this character that is easy to service and maintain, and has relatively few operating parts.

Still another object of the present invention is to provide a device of this character that is relatively inexpensive to manufacture, and is simple yet rugged in construction.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

BRIEF DESCRIPTION OF THE DRAWINGS

Referring more particularly to the accompanying drawings, which are for illustrative purposes only.

DESCRIPTION OF THE PREFERRED EMBODIMENT

Figure 1:
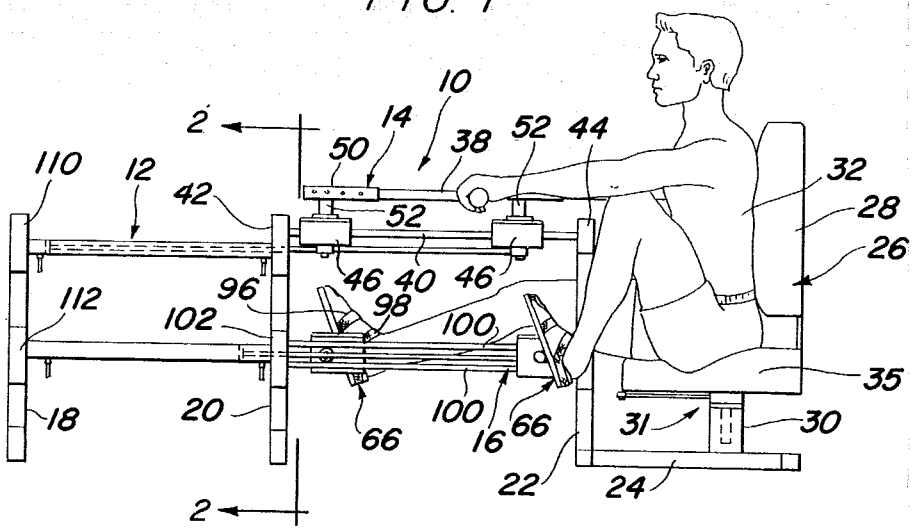
FIG. 1 is a side-elevational view of the present invention showing an outline of an individual seated in one of the several operating positions.

Referring more particularly to FIG. 1, there is shown the present invention which defines a physical-therapy and exercise apparatus, generally designated at 10. This apparatus is particularly suited for use in the rehabilitation of disabled individuals such as stroke victims who are often paralyzed on one side of the body or the other. More often, the paralyzed side inactivates both the arm and the leg on that side. The present apparatus is designed to be selectively adjustable to the user's needs with respect to the affected limbs that require exercise and rehabilitation.

Accordingly, because of the unique structural and operational arrangement of the present invention in cooperation with a hydraulic system, indicated at 12, the user thereof can selectively operate the hydraulically controlled elements by use of one or more of his or her active limbs to assist in promoting an exercising activity for the affected limb members—whether it be a single arm, a single leg, or the combination of an arm and a leg.

Physical-therapy apparatus 10 comprises a frame structure adapted to operably support the hydraulic system 12 and the respective arm-control and leg-control means 14 and 16. It should be noted that various structural arrangements are contemplated, and the structure herein disclosed is an example thereof comprising a front-support member or strut 18, an intermediate-support member or strut 20, and a rear-support member or strut 22. Mounted to rear strut 22 is a base member 24 which extends rearwardly and in which an adjustable chair or seat means 26 is mounted. The chair means includes a chair 28 supported by a post 30 which is secured to base member 24. Support post 30 includes an adjustable means 31, whereby chair 28 is adapted to be rotated about the axis of post 30, and it further provides a means to raise or lower the chair to a height suitable to the user. Thus, the patient can be seated at a comfortable position in accordance with his or her disability, allowing the individual to be aligned with the various control means for maximum operation thereof.

Figure 2:
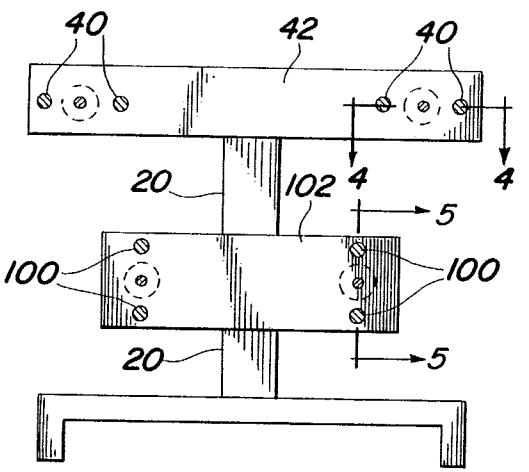
FIG. 2 is an enlarged cross-sectional view of the framework of the device taken substantially along line 2—2 of FIG. 1 thereof.
Figure 3:
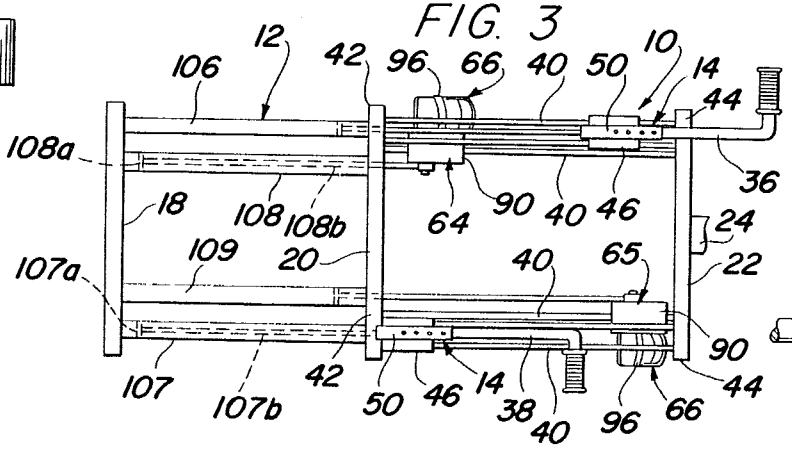
FIG. 3 is a top-plan view of the apparatus, without the seat connected thereto.
Figure 5:
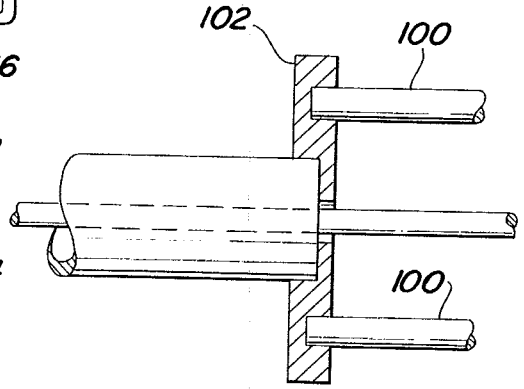
FIG. 5 is an enlarged cross-sectional view taken substantially along line 5—5 of FIG. 2.
Figure 4:
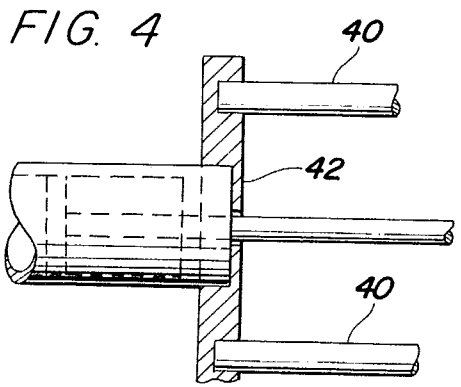
FIG. 4 is an enlarged cross-sectional view taken substantially along line 4—4 of FIG. 2.

As illustrated in FIGS. 1 and 2, both the arm-control means 14 and the leg-control means 16 are secured between the rear and intermediate strut members 22 and 20, respectively. Arm-control means 14 is preferably located chest high to allow the user's arm to be geniculated in a generally horizontal plane. The leg-control means 16 is located under the arm-control means, and preferably at a proper height level with respect to seat 34, or at a suitable position between the seat level and just above the floor level. FIG. 1 illustrates the leg-control means horizontally located at the approximate level of seat 35, whereby the legs of the user are allowed to bend in exercising movements.

Figure 8:
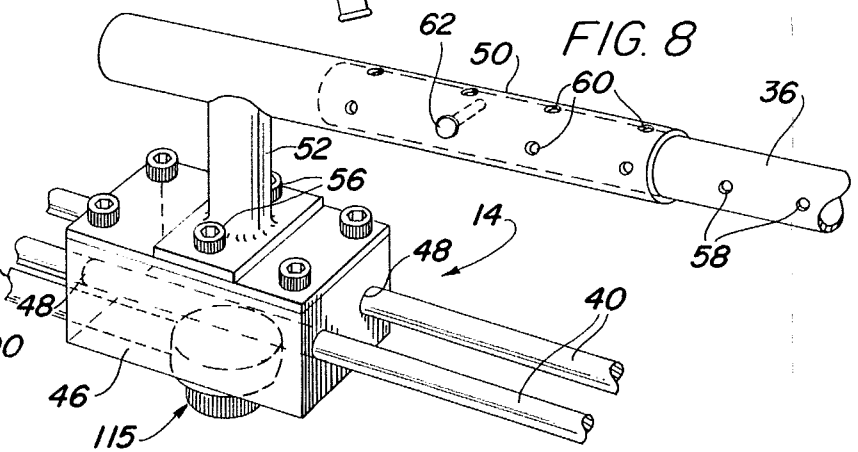
FIG. 8 is a perspective view of the handle-bar attachment and its respective transport block.
Figure 7:
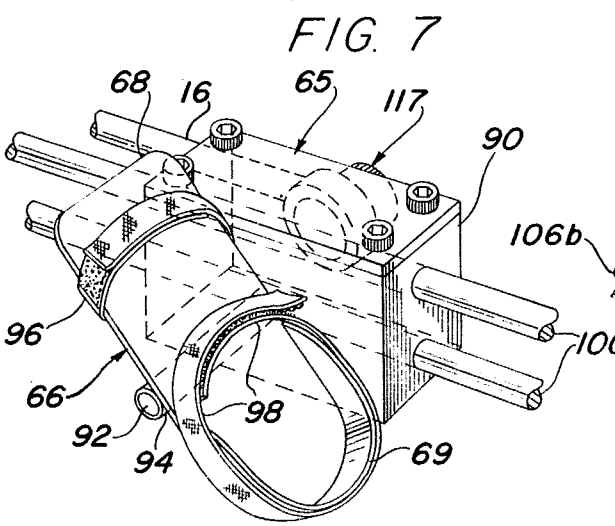
FIG. 7 is a perspective view of the foot-support member attached to the transport-block member.

The arm-control means is defined by a pair of arm-control actuators comprising handle bars 36 and 38, handle bar 36 being arranged to be held by the right hand of the user, and handle bar 38 being oppositely disposed thereto so as to be held by the user's left hand. Thus, the right handle bar 36 and left handle bar 38 are slidably supported by a carriage means comprising a pair of parallel slide-bar members 40. Each bar member is attached at one end to the horizontal truss member 42 of vertical strut 20, and at the opposite end to the horizontal truss member 44 of vertical strut 22, whereby each pair of slide bars 40 is held in a fixed, horizontal, juxtaposed arrangement with respect to the other. Slidably supported on each pair of slide-bar members 40 is a bearing block 46, more clearly illustrated in FIG. 8. Bearing block 46 is formed having a pair of horizontally aligned bores 48 through which the respective slide-bar members 40 are received. Thus, each bearing block is adapted to readily slide back and forth on bars 40 in a reciprocating motion during the operation of the apparatus.

The right-arm and left-arm handle bars 36 and 38 are mounted to their respective bearing blocks 46 by means of a tubular sleeve member 50 which includes a support arm 52 secured to bearing block 46 by any suitable means, such as welding or (as shown) a base plate 54 and screws 56. The connecting ends of handle bars 36 and 38 are provided with a plurality of spacedapart holes 58 that correspond to spaced-apart holes 60 formed in sleeve member 50, whereby a locking means, such as pin 62, can be inserted therethrough so as to selectively position the right and left handle bars, as desired.

Leg-control means 16 comprises a right foot or leg support actuator 64 and a left foot or leg support actuator 65. Each leg actuator includes a foot-support member 66 defined by a shoe plate 68 having a heel member 69, each foot-support member 66 being pivotally mounted to its respective bearing block 90 by means of pivot pin 92 fixed to block 90, the pin 92 extending outwardly therefrom to receive pivot-sleeve member 94 which is secured to the underside of foot-support member 66. It is contemplated that each foot-support member 66 will include securing means such as straps 96 and 98, whereby the inactive legs can be secured to the respective foot-support unit 64 and 65. Bearing block 90 is slidably mounted on a pair of juxtaposed slide-bar members 100. These bar members are shown vertically aligned, but may also be horizontally aligned, as are bars 40. Again, slide bars 100 are attached between struts 20 and 22, their ends being secured to truss members 102 and 104 of vertical struts 20 and 22, respectively.

Hydraulic system 12 comprises four hydraulic cylinder motors 106, 107, 108 and 109. Each of the hydraulic motors is mounted between the front and intermediate struts 18 and 20, the opposite ends of the hydraulic motors being secured to their respective horizontal truss members 42, 102, 110 and 112. Accordingly, each hydraulic cylinder motor includes a piston and a respective piston rod. Right-hand motor 106 includes piston 106*a* and rod 106*b*, the free end of rod 106*b* being attached to bearing block 46 of the right-hand handle bar 36 by an attaching means 115. Left-hand cylinder motor 107 includes piston 107*a* and piston rod 107*b*, the free end thereof being attached to bearing block 46 of the left-hand handle bar 38.

For the foot control, right-foot motor 108 includes piston 108*a* and rod 108*b*, the free end of rod 108*b* being connected to block bearing 90 by attaching means 117. Hence, piston rod 108*b* is interconnected to the right-foot unit 64. Piston 109*a* and rod 109*b* of hydraulic motor 109 are interconnected to the left-foot unit 65.

From the above-described structural arrangements, it can be readily understood that the reciprocating action of right-hand hydraulic motor 106 will effect a corresponding reciprocal action on the right handle bar 36, thus causing the block bearing to slide back and forth along slide bars 40. Thus, the same is true with respect to left-hand motor 107 which activates a corresponding reciprocal movement of the left handle bar 38. The right-foot and left-foot hydraulic motors will correspondingly effect reciprocal movement for each of their respective right and left foot units.

Figure 6A:
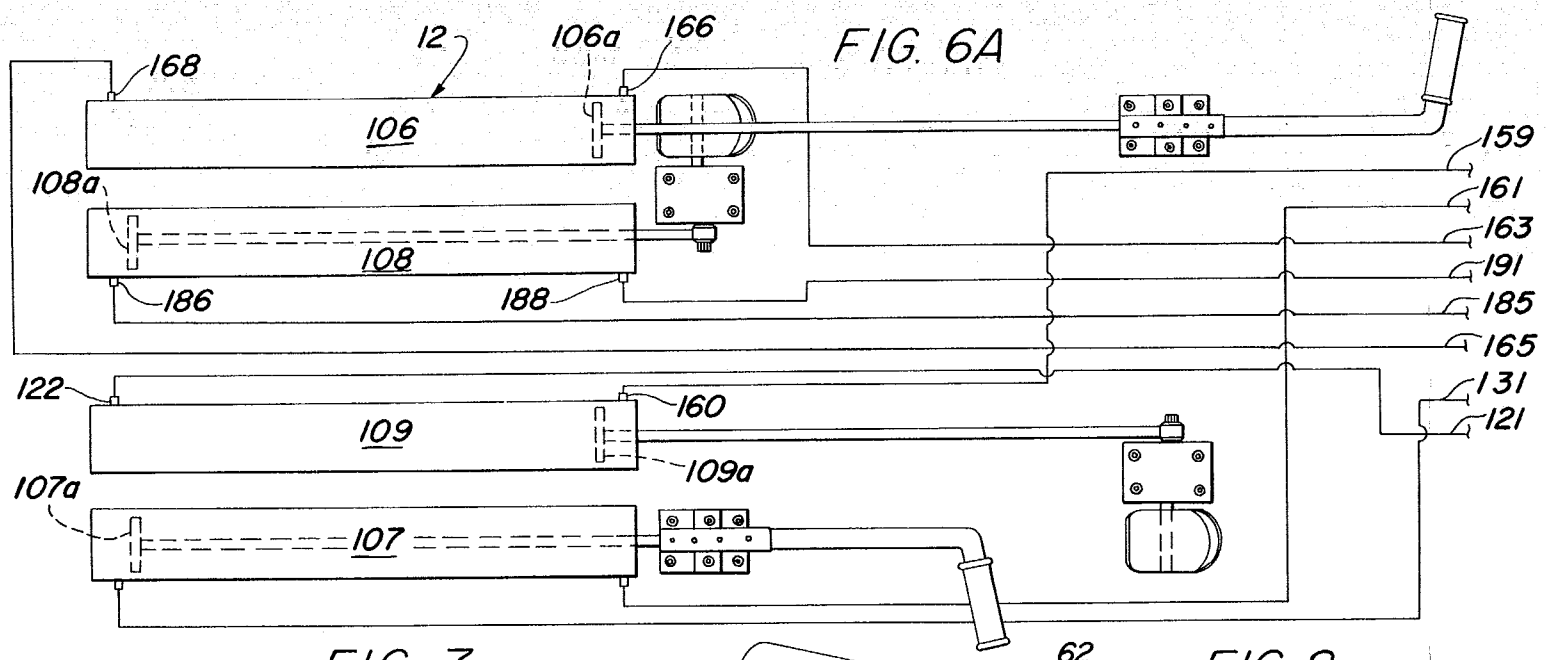
FIGS. 6A and 6B are diagrammatic layout drawings of the hydraulic system, and the associated arm-and-leg-operating devices.
Figure 6B:
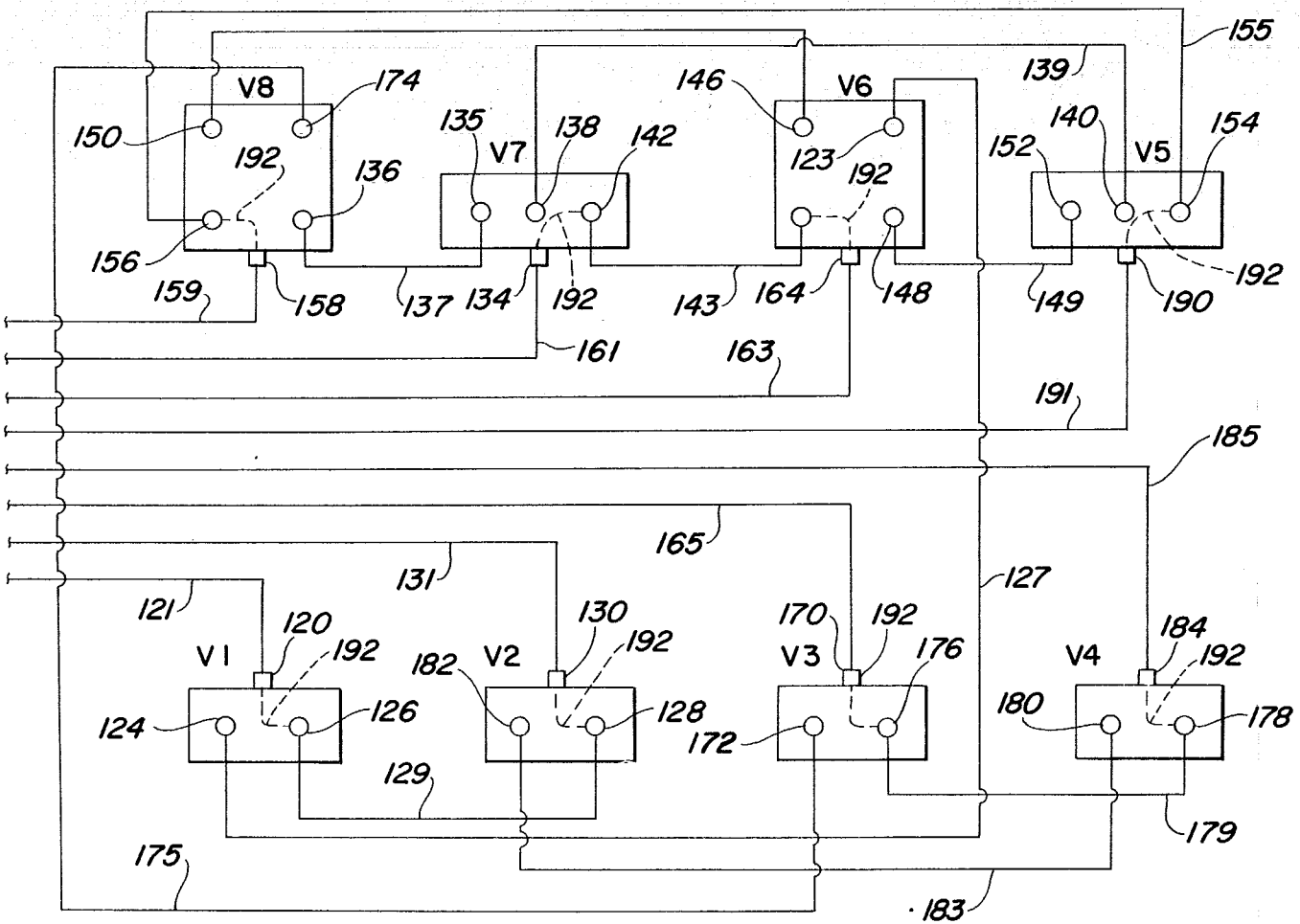

Accordingly, it is an important feature of this apparatus to provide an operational valve-control system which includes eight valves, as illustrated in the diagram of FIG. 6. Valves V1, V2, V3 and V4 are suitable three-way valves such as produced by Whitey Company of Ohio. Valves V5 and V7 are four-way valves, and the remaining valves V6 and V8 are five-way valves.

The arrangement of such a valve system allows the apparatus to be controlled so as to provide a selective exercise for a patient or handicapped individual chosen from a variety of operational possibilities. Thus, physical-coordination training is now possible to meet a particular need of a disabled person. By proper selection of a given set of valves, the present apparatus can provide a means by which arm and leg motions can be selectively coordinated in accordance with individual need.

As an example, FIG. 6 illustrates the selective valve arrangement by which the operator thereof will move his or her arm in a back-and-forth motion, the legs also being allowed to move in a back-and-forth motion with the opposing limbs. That is, when the right leg is extended or retracted, the left arm will also be extended or retracted; conversely, the left leg is retracted when the right leg is extended, and the right arm is retracted when the left arm is extended. Thus, this opposing limb action is analogous to a circadian crawl. Such selected motion arrangements would clearly benefit a stroke victim, who is typically paralyzed on one side of the body, because he or she can use the healthy limbs to assist in exercising the disabled ones. For example, if one is paralyzed on the left side, the right limbs are then used to power the apparatus.

Port 120 of valve V1 is connected by line 121 to left-foot cylinder 109 at port 122, with V1 adjusted to allow flow through ports 124 and 126. Port 124 is connected to port 123 of valve V6 by line 127, and port 126 is connected to port 128 of valve V2 by line 129. Port 130 of V2 is connected by line 131 to port 132 of the left-hand cylinder 107, and port 133 of cylinder 107 is connected to port 134 of valve V7 by line 161. Port 135 of V7 is connected to port 136 of valve V8 by line 137, and port 138 is connected to port 140 of valve V5 by line 139, port 142 of V7 being connected to port 144 of valve V6 by line 143. V6 includes ports 146 and 148, port 146 being connected by line 147 to port 150 of V8, and port 148 being connected by line 149 to port 152 of V5. Port 154 of V5 is connected by line 155 to port 156 of V8, and port 158 of V8 is connected to second port 160 of cylinder 109 by line 159.

Line 163 connects port 164 of V6 to port 166 of right-hand cylinder 106, and line 165 interconnects port 168 of cylinder 106 to port 160 of valve V3. Port 172 of V3 is connected to port 174 of V8 by line 175, while port 176 of V3 is connected to port 178 of valve V4 by line 179. Port 180 of V4 is connected to port 182 of V2 by line 183. Port 184 of V4 is connected by line 185 to port 186 of right-foot cylinder 108, with port 188 of cylinder 108 being connected to port 190 of line 191.

When the circadian crawl is to be employed as described, passage 192 of each valve is positioned as follows:

V1 is positioned connecting ports 120 and 126;
V2 is positioned connecting ports 128 and 130;
V3 is positioned connecting ports 170 and 176;
V4 is positioned connecting ports 178 and 184;
V5 is positioned connecting ports 190 and 154;
V6 is positioned connecting ports 144 and 164;
V7 is positioned connecting ports 134 and 142; and
V8 is positioned connecting ports 156 and 158.

Accordingly, when the right-foot piston 108*a* is in a retracted position, the left-foot piston 109*a* is in the opposite extended position, and the right-hand piston 106*a* is also in an extended position while the left-hand piston 107*a* is in a retracted position. Thus, for example, any movement of the right hand and right foot of the individual will cause the left foot and left hand to react conversely with respect to the limb movements. Therefore, it can be readily understood that by selecting the position of each valve, various operational arrangements can be achieved, such as the following examples:

Left and right hands move in the same direction, while left and right feet move together in the opposite direction from the hands;
Right foot and left hand move in opposite directions;
Left hand and left foot move in opposite directions;
Right hand and right foot move in opposite directions.

If the operational movements of the apparatus are to be changed (for example, to allow the left and right hands to move together, and the left and right feet to move together, but in the opposite direction from the hands), then V1 through V4 remain in the positions shown and described above; passage 192 is repositioned in V5 to connect ports 190 and 140; V6 is repositioned so that passage 192 connects port 134 to 138; and V8 is repositioned to connect ports 158 and 150.

Hence, as long as the individual has at least one moveable limb member, the remaining inactive limbs can be exercised.

The invention and its attendant advantages will be understood from the foregoing description; and it will be apparent that various changes may be made in the form, construction and arrangement of the parts of the invention without departing from the spirit and scope thereof or sacrificing its material advantages, the arrangement hereinbefore described being merely by way of example; and I do not wish to be restricted to the specific form shown or uses mentioned, except as defined in the accompanying claims.

I claim:

1. A physical-rehabilitation and exercising apparatus for the handicapped and disabled individual, wherein the active limb members of the user assist in rehabilitating and exercising the inactive limb members, said apparatus comprising:

a frame structure;

a chair-support means mounted to said frame structure and adapted to support the user thereof while operating said apparatus;

arm-control means slidably mounted to said frame structure for reciprocal horizontal movement along said frame;

leg-control means slidably mounted to said frame structure for reciprocal horizontal movement along said frame, said leg-control means being positioned below said arm-control means; and wherein said arm-control means and said leg-control means are adapted to be reciprocally actuated in an individual selective manner in accordance with the user's requirements;

means for selectively controlling the reciprocating action of said arm and leg control means.

2. An apparatus as recited in claim 1, wherein:

said arm-control means includes a right-arm-control actuator and a left-arm-control actuator; and said leg-control means includes a right-leg-control actuator and a left-leg-control actuator.

3. An apparatus as recited in claim 2, wherein said means for controlling the reciprocating action of said control actuators comprises a hydraulic system including:

a first hydraulic cylinder motor connected to said right-arm-control actuator;

a second hydraulic cylinder motor connected to said left-arm-control actuator;

a third hydraulic cylinder motor connected to said right-leg-control actuator; and a fourth hydraulic cylinder motor connected to said left-leg-control actuator; and a plurality of valves adapted to be selectively arranged to establish predetermined sequences of operation for said hydraulic cylinder motor, whereby said control actuators are activated in corresponding sequential movements.

4. An apparatus as recited in claim 3, wherein each of said right and left arm-control actuators comprises:

an adjustable handle-bar member on which the user's hand is placed when he or she is in a seated position;

reciprocal carriage means forming part of said frame structure, and wherein said handle-bar member is adjustably mounted thereto, each of said carriage means being connected to respective hydraulic cylinder motors; and means for adjusting said handle bar rotationally and longitudinally with respect to said carriage means.

5. An apparatus as recited in claim 4, wherein each of said right and left leg-control actuators comprises:

a foot-support means adapted to receive and support the foot of the user thereof;

means adapted to releasably secure said foot of the user to said foot-support means; and a second reciprocal carriage means forming part of said frame structure, said foot-support means being mounted to said carriage means.

6. An apparatus as recited in claim 5, wherein said reciprocal carriage means for said right and left arm-control actuators comprises:

at least one bearing rod horizontally disposed and secured to said frame structure; and a bearing block slidably mounted on said bearing rod, wherein said bearing block is connected to said respective first or second hydraulic cylinder motor, and wherein said respective handle-bar members are attached to said respective bearing blocks of each right and left arm-control actuator, whereby the active arm or arms of the user can establish a means to activate said hydraulic system in accordance with the selective arrangement of said valves.

7. An apparatus as recited in claim 6, wherein each of said reciprocal carriage means of said right and left leg-control actuators comprises:

at least one bearing rod horizontally disposed and secured to said frame structure; and a bearing block slidably mounted on said bearing rod, wherein said bearing block is connected to said respective third and fourth hydraulic cylinder motors, and wherein said respective foot-support means is mounted to said bearing blocks of said right and left leg-control actuators, whereby the active leg or legs of said user can establish a means to activate said hydraulic system in accordance with the selective arrangement of said valves.

8. An apparatus as recited in claim 7, wherein said chair-support means includes:

an adjustable chair mounted to said frame structure;

means to adjust said chair in a vertical position; and means to rotate said chair about a vertical axis.

* * * * *